United States Patent [19]

Kuroki

[11] 3,998,133

[45] Dec. 21, 1976

[54] RADIAL TYPE HYDRAULIC PUMP MOTOR

[75] Inventor: Masatake Kuroki, Yono, Japan

[73] Assignee: Sanwa Seiki Mfg., Co., Ltd., Japan

[22] Filed: Nov. 5, 1975

[21] Appl. No.: 629,069

[30] Foreign Application Priority Data

Nov. 14, 1974 Japan ..... 49-130471

[52] U.S. Cl. ..... 91/488; 91/495

[51] Int. Cl.[2] ..... F01B 13/06

[58] Field of Search ..... 91/472–498

[56] References Cited

UNITED STATES PATENTS

| | | | |
|---|---|---|---|
| 2,392,754 | 1/1946 | Mercier | 91/494 |
| 3,211,105 | 10/1965 | Bush et al. | 91/482 |
| 3,777,624 | 12/1973 | Dixon | 91/488 |
| 3,807,282 | 4/1974 | Gransten | 91/496 |

*Primary Examiner*—William L. Freeh
*Attorney, Agent, or Firm*—Jay L. Chaskin

[57] ABSTRACT

A radial type hydraulic pump motor according to the present invention has pistons, each of which is formed at its head portion with a concave or convex spherical surface. Engaged spherically with said spherical surface head portion is a piston shoe whose outer planar portion is slidably engaged with the inner planar portion of a crescent-shaped segment arcuately engaged with the inner peripheral surface of a drum case. Said piston shoe is formed at its outer planar portion with a hydraulic recess equal to the effective pressure receiving area of piston in area. Said recess is maintained in communication with a cylinder chamber. Accordingly, said spherically engaging portion and arcuately engaging portion make little sliding movements and only the outer planar portion of piston shoe and the inner planar portion of segment mutually make sliding movement under little contact pressure, thereby causing little wear to said engaging portion and sliding portion.

3 Claims, 4 Drawing Figures

RADIAL TYPE HYDRAULIC PUMP MOTOR

BACKGROUND AND SUMMARY OF THE INVENTION

This invention relates to a radial type hydraulic pump motor comprising a rotating cylinder block and a drum case rotating eccentrically with said cylinder block.

An object of the present invention is to provide a radial type hydraulic pump motor wherein a piston couplingly inserted into a cylinder block is formed at the head portion thereof with a concave or convex spherical surface, with which is engaged a piston shoe having a convex or concave surface at the inner side thereof and a planar surface at the outer side thereof, further a crescent-shaped segment having a curvature equal to the inner surface of the drum case at the outer side and a planar surface at the inner side thereof is interposed between said piston shoe and the inner peripheral surface of drum case, and a pressure balancing recess communicated with a cylinder chamber through a small diameter passageway is provided in the outer planar portion of piston shoe, whereby said pump motor is suitable for operation under high pressure and can attain a high efficiency and long service life.

Additionally, another object of the present invention is to provide a radial type hydraulic pump motor wherein the segment is provided at opposite end portions thereof with guide projections, retaining plates are floatingly provided at both sides of the cylinder block, said plate have guide grooves for coupling to said guide projections and are adapted to regulate the segment in both radial and circumferential directions of drum case, said retaining plate is provided with a plurality of guide holes for bringing the rotating movements of segment and cylinder block in synchronism, and said guide holes are adapted to be guided by rollers which are mounted at opposite ends of a plurality of pins inserted into and secured to the cylinder block, the diameter of said guide hole is made equal to the sum of the diameter of roller and doubled value of eccentricity to permit the retaining plate to rotate coaxially with the drum case while the cylinder block is rotating eccentrically whereby the segment is controlled in its position relative to other internal rotating members, with the result that the segments can perform an extremely stabilized operation.

DESCRIPTION OF THE PREFERRED EMBODIMENT

Figure 1:
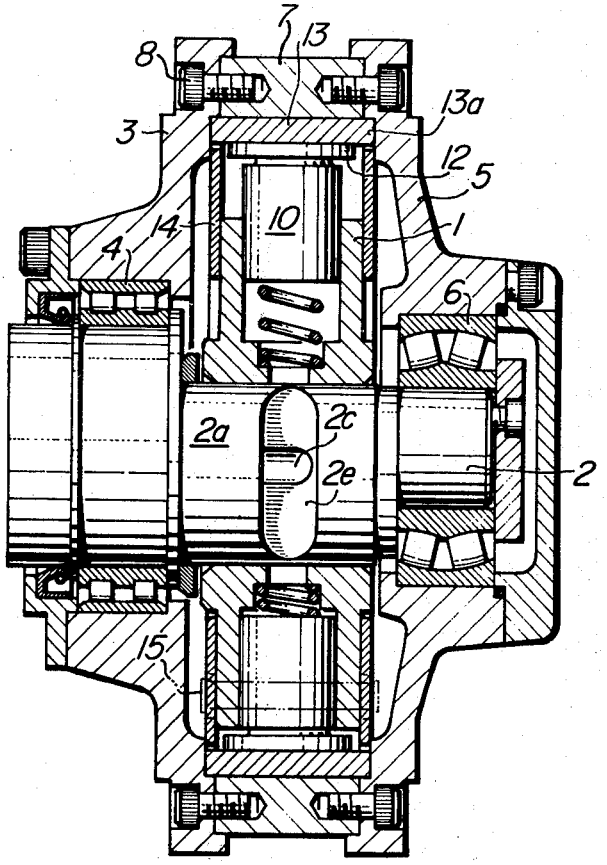
FIG. 1 is a side view of one embodiment of the present invention, partly longitudinally sectional.

A cylinder block 1 is rotatably coupled on an eccentric shaft portion 2a of a shaft 2. The shaft 2 is supported by a bearing 4 couplingly inserted into a case cover 3 at one end thereof and by bearing 6 couplingly inserted into a case cover 5 at the other end. The case covers 3 and 5 have a drum case 7 interposed therebetween and threadably coupled thereto by a bolt 8. The eccentric shaft portion **2*a* is longitudinally provided in the interior thereof with a pair of oil inflow port 2*b* and oil outflow port 2*c*, and further said eccentric shaft portion 2*a* is provided with a pair of slide valve grooves 2*d* and 2*e*, to which respectively said inflow port 2*b* and outflow port 2*c*** are open.

Figure 2:
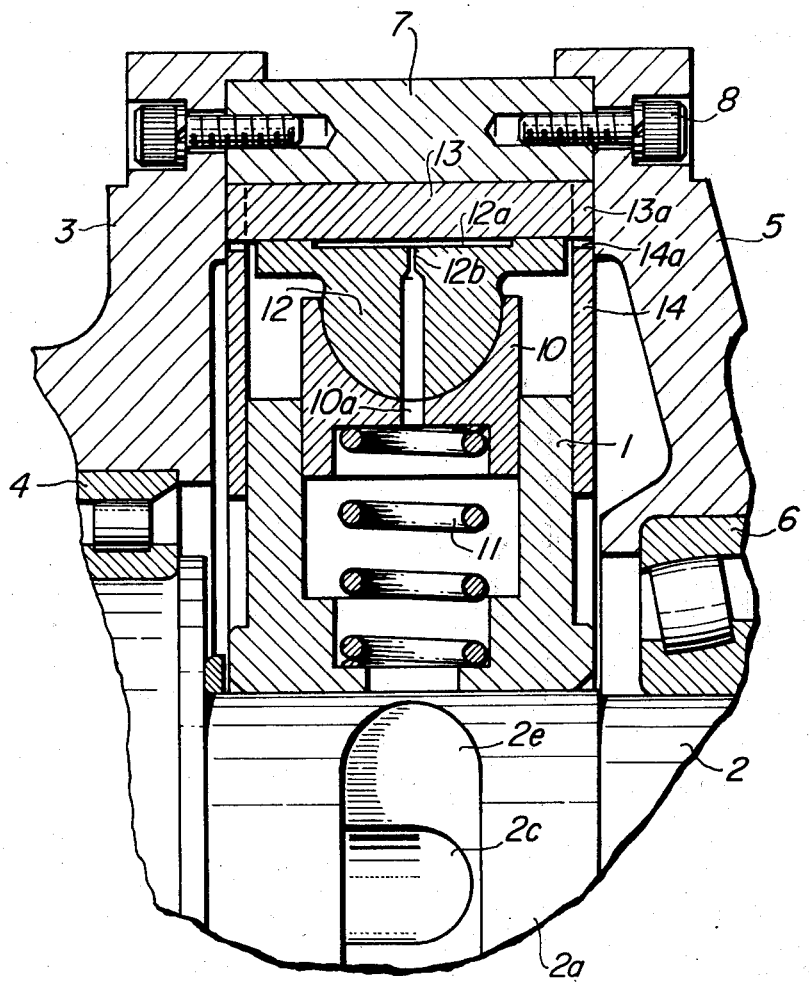
FIG. 2 is a partly enlarged view of FIG. 1.
Figure 3:
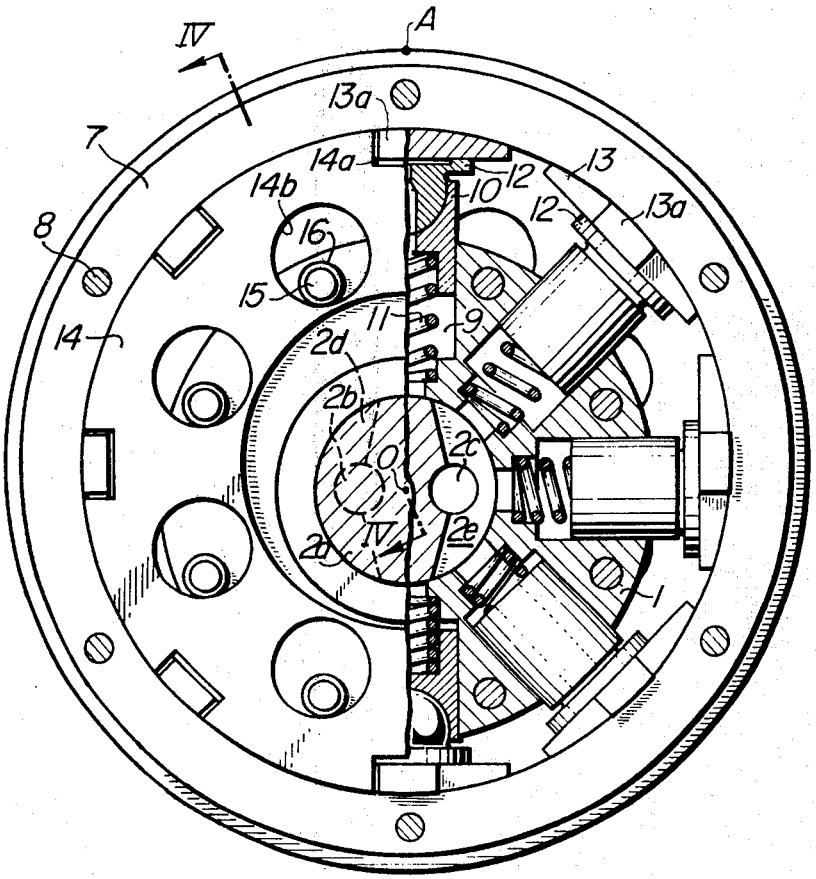
FIG. 3 is a frontal view showing the embodiment with the cover thereof removed, partly longitudinally sectional.
Figure 4:
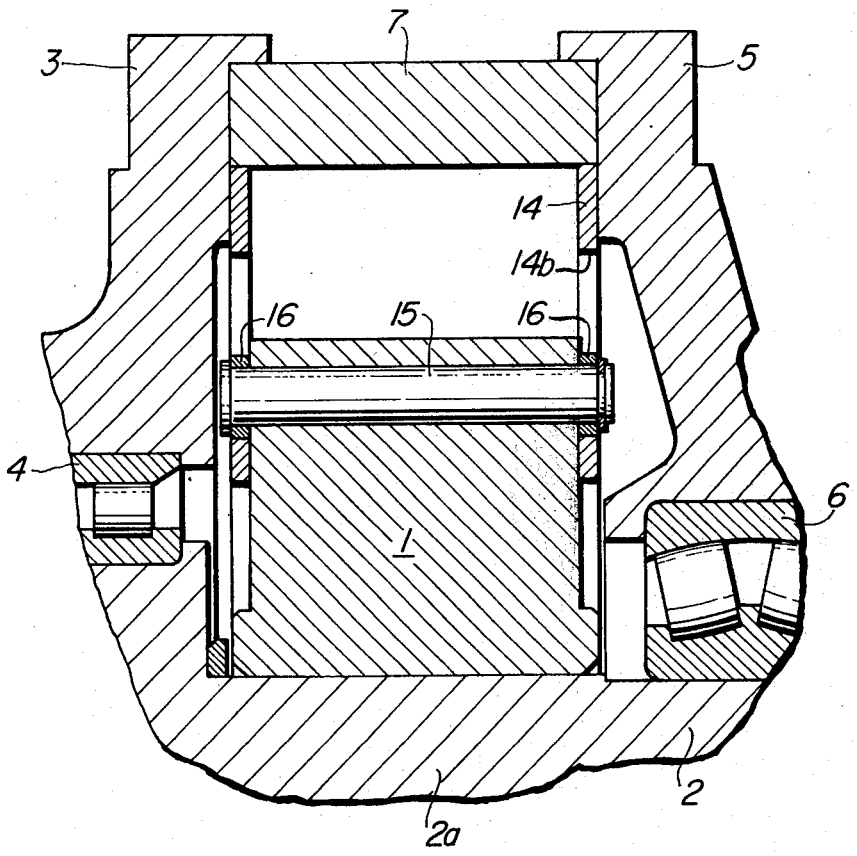
FIG. 4 is a sectional view taken on line IV—IV of FIG. 3.

The cylinder block 1 is radially provided with a plurality of cylinder chambers 9, into each of which a piston 10 and a spring 11 are inserted with the spring 11 radially outwardly biasing the piston 10. A concave (or convex) spherical head portion of piston is engaged with a piston shoe 12 having a convex (or concave) spherical surface at the inner side thereof and a planar surface at the outer side thereof, as shown in FIG. 2. Interposed between the piston shoe 12 and the inner peripheral surface of drum case 7 is crescent-shaped segment 13 whose outer side surface has a curvature equal to the curvature of the inner peripheral surface of drum case and whose inner surface is a planar surface. The segment 13 has a center aligned with the central axis of the piston at the lowermost position or uppermost position thereof as shown in FIG. 3. Additionally, the piston shoe 12 is provided in the outer planar portion thereof with a hydraulic recess 12a having an area substantially equal to the effective pressure receiving area of piston 10. The recess **12*a* has a shallow cylindrical shape, preferably. The recess 12*a* is maintained in communication with the cylinder chamber 9 through a small diameter passageway 12*b* provided in the piston shoe 12 and a pasageway 10*a* provided in the piston 10, whereby oil pressure applied to the piston 10 in the cylinder chamber 9** is introduced into the recess.

The segment 13 is provided at opposite end portions thereof with a pair of guide projections **13*a*. Additionally, provided floatingly at both side of the cylinder block 1 are pair of retaining plates 14. Said retaining plate 14 has a plurality of guide grooves 14*a* adapted to engage guide projections 13*a* of segments 13 to thereby retain the segment 13 in the radial direction relative to the inner surface of drum case 7 and guide said segment in the circumferential direction along the inner surface of drum case. Furthermore, said retaining plate 14 is provided with a plurality of guide holes 14*b* adapted to be guided by rollers 16 which are mounted at opposite ends of a plurality of pins 15 inserted into and secured to the cylinder block 1, thereby bringing the rotating movements of the segment 13 and cylinder block 1 in synchronism. Additionally, the diameter of guide hole 14*b* is made equal to the sum of the diameter of roller and doubled value of eccentricity, whereby rotation of the retaining plates 14 are maintained coaxially with that of drum case 7 while cylinder block 1** is rotating eccentrically.

In the radial type hydraulic pump motor according to the present invention as arranged above, the contact surface between the segment 13 and the piston shoe 12 is constantly kept at a right angle to the central axial line of piston whenever the drum case 7 and cylinder block 1 are rotated in synchronism in the normal operation. Therefore, there is little sliding movement in the spherical engaging surfaces between the head portion of piston 10 and piston shoe 12, with the result that there occurs no wear due to the friction in said engaging surfaces. As the segment 13 passes by the position where the axial line of piston shoe 12 and the central line of segment 13 are aligned, i.e., the position OA in FIG. 3, the piston 10 commences to impart a component of force in the circumferential direction to the segment 12 by way of the piston shoe 12 and the segment 12 tends to move along the inner surface of drum case 7, but there is no possibility for segment 13 to slide along the inner surface of drum case 7 because of the frictional force between the segment 13 and drum case 7 being far larger the component of force, with the result that only the piston shoe 12 slides along the inner planar portion of segment 13. In this case, since the piston shoe 12 is provided with hydraulic recess 12*a* serving as a pressure balancing means, little sliding pressure acts on the sliding surfaces and wear is extremely slight. Additionally, although there is little sliding movement between the segment 13 and the inner surface of drum case 7 in normal operation as described above, only when high speed operation is abruptly interrupted under the condition where the inflow port 2*b* and outflow port 2*c* are open, i.e., when the drum case 7 is abruptly interrupted by a constraining force from outside, the rotating members in the drum case 7 tend to continue to rotate relative to drum case due to the force of inertia and is inclined to move relative to drum case 7 through certain degrees by the inertia force overcoming the frictional force between the segment 13 and drum case 7. At this time, since each of the segment 13 is regulated by retaining plate 14, it is held in its position relative to other internal rotating members during the sliding movement along the inner surface of drum case 7. Then in the case of abrupt interruption of operation, energy is absorbed by sliding movement of the segment 13 without the internal rotating members deviating from their normal relative positions and consequently the shock due to abrupt interruption of operation is relieved and damages to the internal rotating members can be avoided. Additionally, sliding movement between the segment 13 and the inner surface of drum case 7 occurs only in this case, so that a very slight wear is caused to said sliding portion.

As has been described above, the radial type hydraulic pump motor according to the present invention is arranged such that sliding movement is made between the planar portions of segment 13 and piston shoe 12 under little contact pressure, and little sliding movements occur at the spherically engaging portion of head portion of piston 10 and piston shoe 12 and the arcuately engaging portion of segment 13 and drum case 7. For this reason, slight wears are caused to said spherically engaging portion and the arcuately engaging portion, and a little wear is caused to the sliding portion between the segment 13 and piston shoe 12. Furthermore, since the surfaces of piston shoe 12 and segment 13 which form the sliding portion are planar, a surface hardening treatment for high air-tightness can be readily carried out. Additionally, since the segment 13 is constantly controlled in its position relative to other internal rotating members by being guided by the guide groove 14*a* of retaining plate 14 and also assured in its synchronized rotating movement with the cylinder block by means of the guide groove 14*b* of retaining plate 14, operation is stabilized and there is little possibility of trouble occurence. Thus, the radial type hydraulic pump motor according to the present invention presents great advantages in attaining high pressure operation, high efficiency in operation and long service life.

Various modification to the disclosed invention can be made by one skilled in the art without departing from the invention which is defined by the claims.

What is claimed is:

1. A radial type hydraulic pump motor comprising a rotating cylinder block and a drum case rotating eccentrically with respect to said cylinder block, said cylinder block being rotatably mounted on an eccentric shaft and having a plurality of cylinder chambers radially provided therein, and a like plurality of pistons inserted in said cylinder chambers and slidably movable inward or outward relative to said eccentric shaft, said piston having at the head portion a concave or convex spherical surface, with which is engaged a piston shoe having a complimentary convex or concave spherical surface at an inner side and a planar surface at an opposite side, a crescent-shaped segment having a curvature equal to the inner peripheral surface of the drum case is interposed between said piston shoe planar surface and the inner peripheral surface of the drum case, said piston shoe having in the central portion of the planar surface a hydraulic recess having an area substantially equal to the effective pressure receiving area of the piston, said recess communicating with the cylinder chamber through a passageway provided in the piston shoe and a passageway provided in the head portion of the piston, and retaining means are provided on the cylinder block to engage said crescent-shaped segment for regulating the movement of the segment in both radial and circumferential directions relative to the drum case.

2. A radial type hydraulic pump motor as set forth in claim 1, wherein said segment is provided at opposite end portions thereof with a pair of guide projections, a pair of retaining plates are floatingly provided on the cylinder block at both sides thereof, said retaining plate having a plurality of guide grooves engaging said guide projections and adapted to control the segment in both radial and circumferential directions relative to the drum case, said retaining plate is provided with a plurality of guide holes for bringing the rotating movements of said segment and cylinder block in synchronism, said guide hole being adapted to be guided by means of rollers which are mounted at opposite end of a plurality of pins inserted into and secured to the cylinder block, and the diameter of said guide hole being made equal to the sum of the diameter of roller and doubled value of eccentricity to permit the retaining plate to rotate coaxially with the drum case while the cylinder block is rotating eccentrically.

3. A radial type hydraulic pump as set forth in claim 1 wherein the retaining means comprises a pair of plates disposed on two sides of the cylinder block.

* * * * *